United States Patent [19]

Talamantez

[11] Patent Number: 4,660,543

[45] Date of Patent: Apr. 28, 1987

[54] APPARATUS FOR HEATING, STORING AND TRANSFERRING OF HEAT

[76] Inventor: Rudolph Talamantez, 9 Oldham Rd., Silver Spring, Md. 20901

[21] Appl. No.: 488,349

[22] Filed: Apr. 25, 1983

[51] Int. Cl.[4] ..... F24H 7/00

[52] U.S. Cl. ..... 126/400; 237/53; 237/55; 126/99 R; 126/110 C

[58] Field of Search ..... 126/400, 99 R, 102, 126/110 C; 237/50, 55; 165/DIG. 2, 901

[56] References Cited

U.S. PATENT DOCUMENTS 4,340,032 7/1982 Smith ..... 126/400

4,473,060 9/1984 Bangerter ..... 237/50

*Primary Examiner*—Henry Bennett

[57] ABSTRACT

An apparatus having a heating chamber, (combustion chamber) a heat storing means and heat transferring means of the kind used in households, commercial furnaces, heaters, boilers, etc., having a heating chamber which is spherically arranged; with ports for receiving fuels and a valve for regulating the internal pressure and temperature, allowing for excessive heat to be exhausted into a secondary heat recovery manifold. The spherical heating chamber allows the heat to radiate uniformly. Said heat is stored by mantle material. Said mantle being entirely surrounded by a crust layer and insulating means and an outside protective covering. The apparatus also having means for transferring the stored heat for heating purposes as is generally in common use.

8 Claims, 4 Drawing Figures

APPARATUS FOR HEATING, STORING AND TRANSFERRING OF HEAT

BACKGROUND OF INVENTION

In general use this invention relates to household and commercial heating furnaces, heaters, boilers, etc., having in part a heating chamber, heat storage means and a heat exchanger, so arranged to conveniently extract heated air, liquids and gases for general heating purposes.

DESCRIPTION OF PRIOR ART

Heretofore many types of heating apparatuses have been proposed having heating chambers and heat exchangers and many of them in the past have performed using excessive scarce fuel and consequently contributing to an ever continual increase in operating expense. Further other models often operate in faulty conditions which allow toxic gas fumes to leak out into the breathable air stream thereby creating an unhealthful situation.

SUMMARY OF INVENTION

The difficulties of the prior Art may be overcome and in accordance with this invention there is presented a heating apparatus having a spherically arranged heating chamber means, a port for receiving ignitable fuels, whereby the heat generated may be uniformly transferred to the heat storage means and heat exchanger means. Further therein the spherically arranged heating chamber means opposite the fuel port is located a secondary port means for regulating the internal pressures and temperature, affording great heat transfer with minimal loss. Further the spherical heat chamber means allows better heat disbursement and more rapid heat transfer with little loss of the heat. Said heat is stored in a mantle substance means. There it is gathered and there retained, forming a reservoir of heated molted liquefied matter, which may be later used, long after the fuel supply has been automatically shut off, or is exhausted or is disrupted, closed off or temporarily shut for emergency purposes. The stored heat is transferred out for general use by primary heat transfer manifold means. Separately another heat source means is available for other uses by secondary heat exchanger means maximizing the amount of usable available heat, providing a greatly improved, overall operating economy. Said spherical heating chamber allows heat expansion uniformly to act in all directions upon the shell wall minimizes the possibility of breakage to the heat chamber means, and when a breakage does occur, toxic gases can not enter into the air stream which is being used for heating purposes, eliminating any possibility of contaminating any breathable air.

DESCRIPTION OF THE PREFERRED EMBODIMENT

Figure 1:
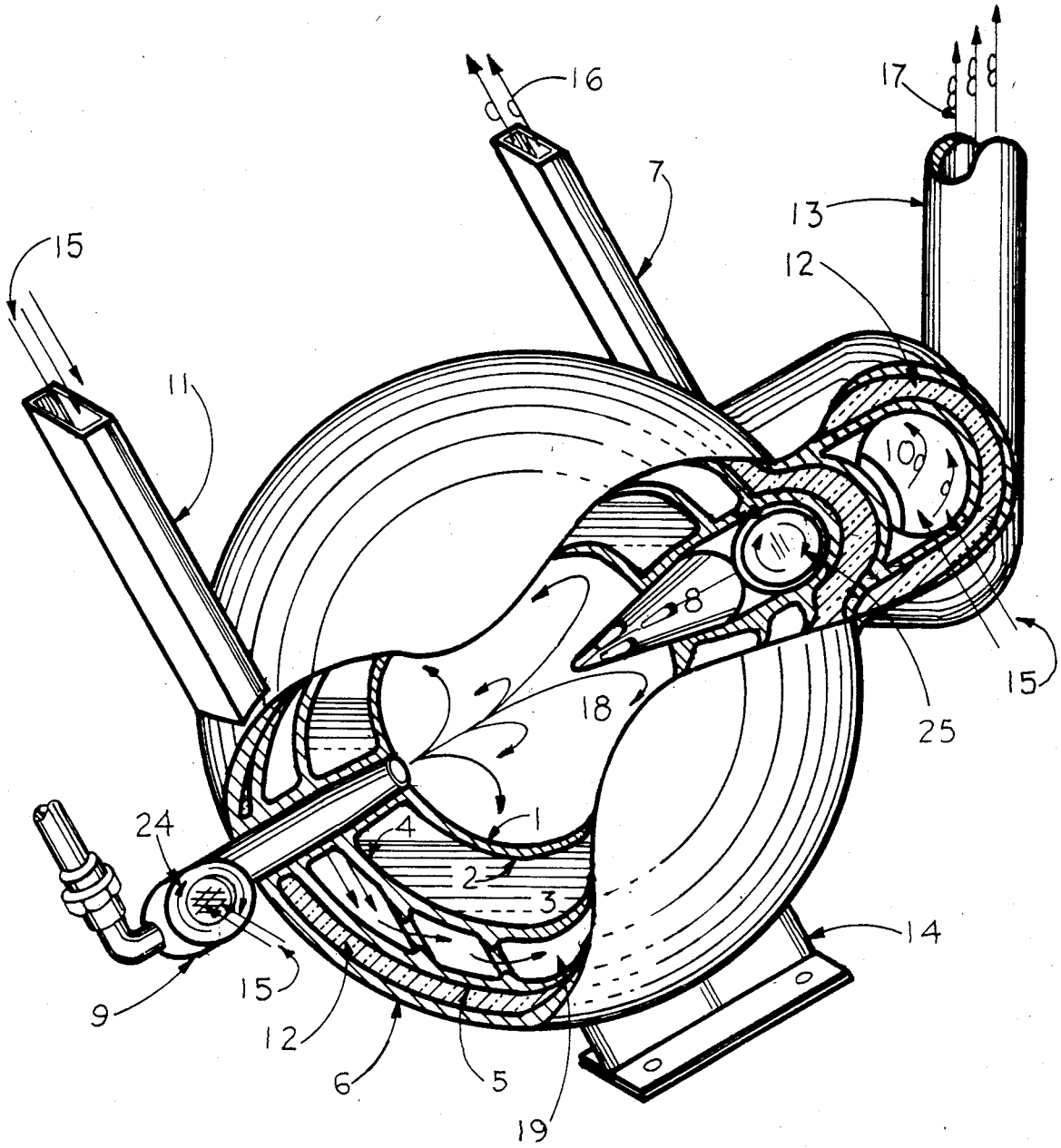
FIG. 1 shows the first embodiment of the indicated.

Referring to FIG. 1 there is shown an isometrical drawing of the first embodiment which includes 1 a spherical combustion heating chamber; 2 a spherical heat chamber shell, 3 Mantle substance means preferably silica and other like Colloidal Materials, or any other type of gels and tar materials may be used; 4 Crust layer, 5 Heat transfer cover 6 Shroud outer overall cover; 7 Heat transfer Manifold 8 Pressure regulator valve means, 9 Fuel supply nozzle, 10 Heat Scavenger, 11 Domestic cold air supply Housing, 12 Insulation Barrier means, 13 Smoke Stack, 14 Mounting means, 15 Cold Air supply, 16 Hot air for domestic uses; 17 Smoke, 18 Combustion Gases, 19 Heated air (Heat transfer) for domestic uses.

To better understand the construction and operating features of this invention, it is necessary to note that predominately the heating (combustion) chamber is configured as a hollow vessel 2 spherically arranged 1. The heating chamber 1 & 2 is further arranged with a Fuel Supply Nozzle 9 which delivers fuel for burning threin and when ignited the heat derived therefrom is absorbed by heat storage means mantle 3 silical gel material or tars becoming very hot. Said materials are transformed into a liquefield molten substance, therein creating a reservoir of stored heat, readily available for heating purposes. A protective Crust layer 4 restricts the melted mantle 3 from escaping. In order to control this process a regulator valve means 8 is provided to automatically cut off the fuel supply 9 when the desired operating temperature is reached. When the regulator valve means 8 is opened hot gases are exhausted and heat collected in an auxiliary heat exchanger 10 said heat may also be used for other purposes thereby further improving the supply of available heat. Further this process allows for a very simple and yet efficient manner of safely storing heat. When in general use the heat is removed by a primary heat transfer manifold means 7. Provides a very efficient manner of heat transfer with minimal heat losses. It may readily be seen that a barrier of insulation material means 12 is arranged around the entire internal heat transfer Air Chamber 19 which surrounds the mantel 3 minimizing and retarding any losses further provide increased efficiency of this process. It may also be readily seen that an outside overall cover shroud 6 is provided to give rigidness and stable means for mount of legs means 14.

Though this invention has been fully described with respect to a specific embodiment thereof, many other variations will become apparent to those who are skilled in the Art. It is therefore the intention that the appended claims be interpreted as broadly as possible in view of the prior ART to include variations and modifications.

Figure 2:
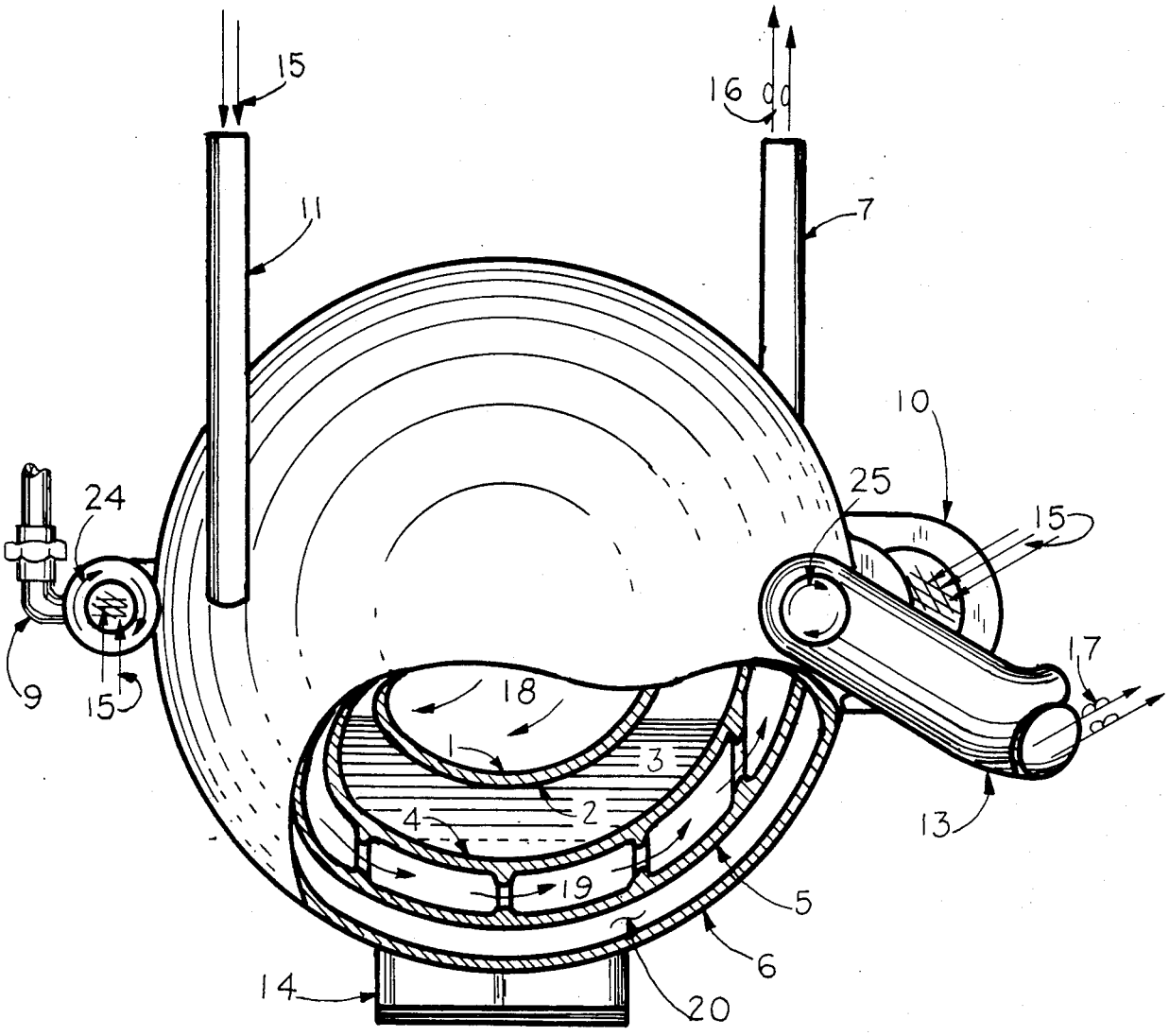
FIG. 2 shows the second embodiment of the invention.
Figure 3:
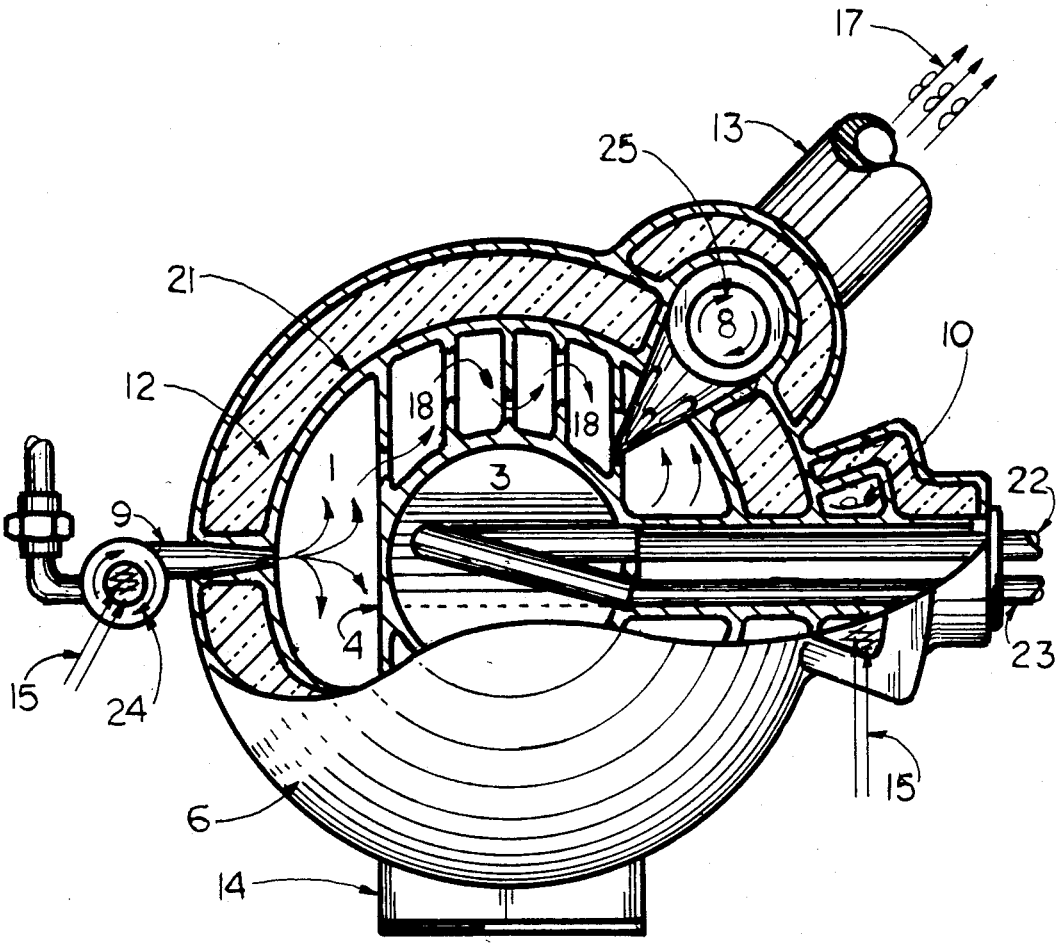
FIG. 3 shows the third embodiment of the invention.
Figure 4:
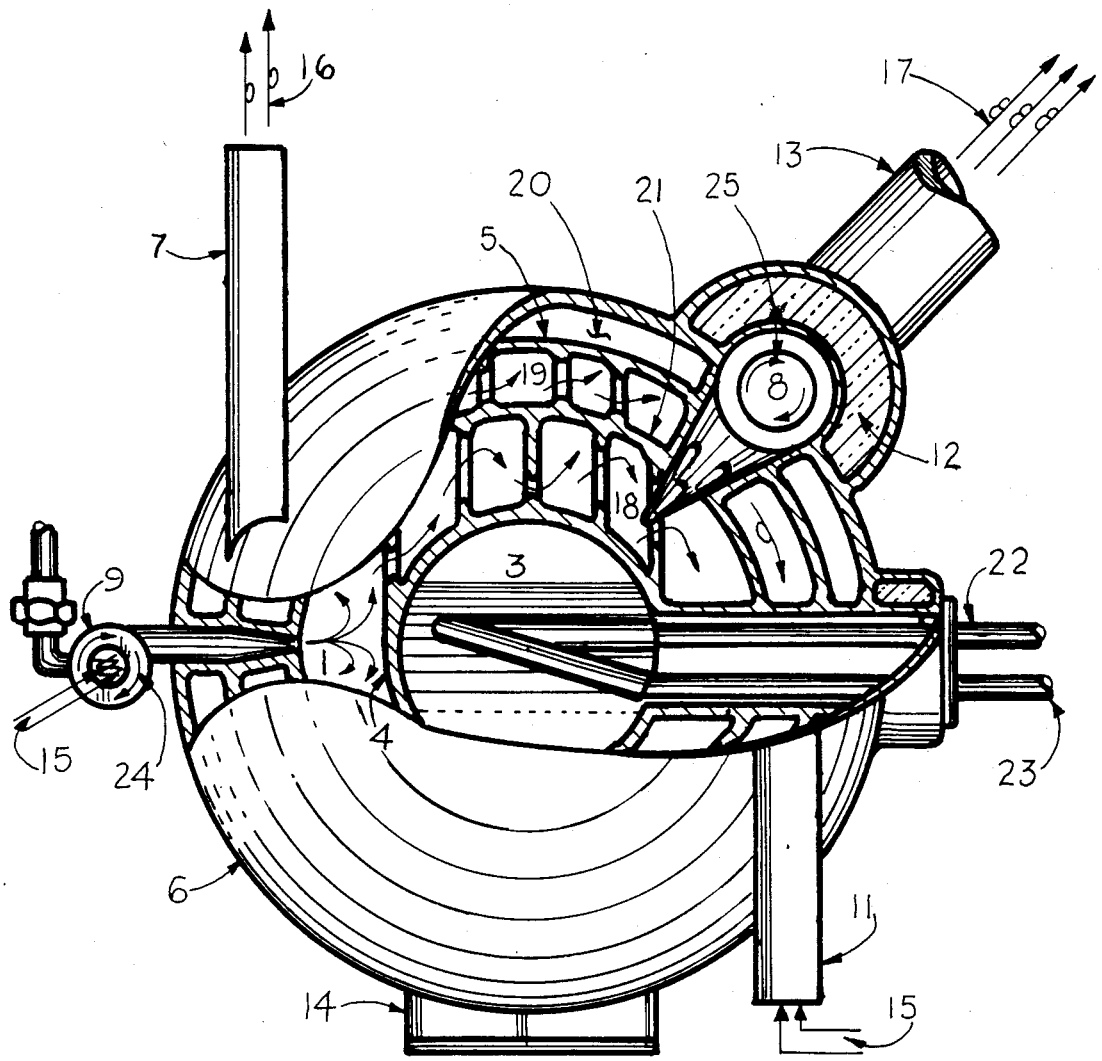
FIG. 4 shows the fourth embodiment of the invention.

FIG. 2 shows the second embodiment with vacuum means for Insulation. 20 represents a vacuum barrier means for insulation purposes. FIG. 3 shows the third embodiment with water or liquid for heat transfer 22 & 23. FIG. 4 shows the fourth embodiment with both water or liquid and air heat transfer and a 20 vacuum means for insulation purposes.

DESCRIPTION OF THE SECOND EMBODIMENT

Referring to FIG. 2 which includes 1 a spherical combustion heating chamber; 2 a spherical heat chamber shell, 3 Mantle substance means preferably silica and other like Colloidal Materials, or any other type of gels and tar materials may be used; 4 Crust layer, 5 Heat transfer cover 6 Shroud outer overall cover; 7 Heat transfer Manifold, 8/25 Pressure regulator valve means, 9/24 Fuel supply nozzle, 10 Heat Scavenger, 11 Domestic cold air supply Housing, 13 Smoke Stack, 14 Mounting means, 15 Cold Air supply, 16 Hot air for domestic uses; 17 Smoke, 18 Combustion Gases, 19 Heated air (Heat Transfer) for domestic uses.

To better understand the construction and operating features of this invention, it is necessary to note that predominantly the heating (combustion) chamber is configured as a hollow vessel 2 spherically arranged 1. The chamber 1 & 2 is further arranged with a Fuel Supply Nozzle 9 which delivers fuel for burning therein and when ignited the heat derived therefrom is absorbed by heat storage means mantle 3 cilical gel material or tars becoming very hot. Said materials are transformed into a liquefied molten substance, therein creating a reservoir of stored heat, readily available for heating purposes. A protective Crust layer 4 restricts the melted mantle 3 from escaping. In order to control this process a regulator valve means 8 as in FIG. No. 1 is provided to automatically cut off the fuel supply 9 when the desired operating temperature is reached. When the regulator valve means 8 is opened hot gases are exhausted and heat collected in an auxiliary heat exchanger 10 said heat may also be used for other purposes thereby further improving the supply of available heat. Further this process allows for a very simple and yet efficient manner of safely storing heat. When is general use the heat is removed by a primary heat transfer manifold means 7. Provides a very efficient manner of heat transfer with minimal heat losses. It may readily be seen that a barrier of vacuum insulation means 20 is arranged around the entire internal heat transfer Air Chamber 19 which surrounds the mantel 3 minimizing and retarding any losses further provide increased efficiency of this process. It may also be readily seen that an outside overall cover shroud 6 is provided to give rigidness and stable means for mount of legs means 14.

When in general use the stored heat 3 is transferred into the hot air chamber 19 and it then further transferred into the hot air manifold 7; the heated air 16 may now be used for domestic heating purposes.

DESCRIPTION OF THE THIRD EMBODIMENT

Referring to FIG. 3 which includes (1) spherical (combustion) Heating chamber, (3) colloidal material such as silica gel, any other similar gels and tar material may be used, (4) Crust layer housing, (6) Shroud outer overall cover, (8) pressure regulator, (9) Fuel supply nozzle, (10) Heat scavenger, (12) Insulation barrier means, (13) exhaust stack, (14) Mounting base, (15) cold air supply, (17) Exhaust gases, (18) heated air transfer, (21) combustion chamber housing, (22) cold Water input manifold, (23) hot water return manifold, (24) Fuel supply regulator, (25) Pressure regulator control means.

To better understand the construction and operating features of this invention, it is necessry to note Mixed fuel is introduced under a regulated pressure (24) and said regulated pressure is controlled by the pressure regulator (8) (25), said fuel mixture is introduced into a spherical combustion chamber (1) (21), where the fuel mixture is ignited creating a very hot combustion (18), the heat derived from this combustion is transferred into the crust layer housing (4), there it is absorbed and stored in a colloidal (silica gel) like material, becoming very hot, there said colloidal material liquefies and is transformed into a molten substance therin creating a reservoir of stored heat, readily available for heating purposes. The spherical combustion chamber (21) provides internal support containment means for the Insulation barrier means (12). The whole assembly is covered with an overall covering Shroud (6) and is supported with (14) mounting base, (15) cold air is supplied to the fuel nozzle (9) and (24), another cold air supply is introduced as a secondary heat source at the scavenger (10), the recycled heated air may be used as required. When in general use the stored heat maybe removed by means of a hot water manifold (23) and maybe used for domestic purposes, (22) cold water replenishment supply manifold.

DESCRIPTION OF THE FOURTH EMBODIMENT

Referring to FIG. 4 which includes (1) Spherical (combustion) heating chamber, (3) colloidal material, such as silical gel, any other similar gels and tar materials may be used, (4) crust layer housing, (5) inner containment housing, (6) Shroud outer overall cover, (7) Hot air manifold, (8) pressure regulator, (9) Mixed fuel supply nozzle, (11) cold air intake manifold, (12) Insulation barrier means, (13) Exhaust stack, (14) Mounting means, (15) Cold air supply, (16) Heated air for domestic uses, (17) Exhaust gases, (18) Heated air transfer, (19) Secondary heated air transfer, (20) Vacuum insulation means, (21) Combustion chamber housing, (22) cold water supply input, (23) hot water return manifold, (25) pressure regulator adjustment control means.

To better understand the construction and operating features of this invention it is necessary to note that mixed fuel is introduced under regulated pressure (24), and said regulated pressure is controlled by the pressure regulator (8) (25). Said fuel mixture is introduced into a spherical combustion chamber (1) & (21), where the fuel mixture is ignited creating a very hot combustion (18), the heat derived from this bombustion is transferred into a crust layer housing (4), there it is absorbed and stored in a colloidal (silica gel) like material, becoming very hot, there said colloidal material liquefies and is transformed into a molten substance therein creating a reservoir of stored heat, readily available for heating purposes. The spherical combustion chamber (21) is surrounded by a secondary chamber (5), housing where heated air (19), is transferred into the hot air manifold, hot air (16), may be used for domestic purposes. A vacuum insulation barrier means (20), minimizes heat loss. The whole assembly is covered with an overall covering shroud (6), which is supported with (14) mounting means, (15) cold air supply is introduced at the fuel supply nozzle and at the cold air intake manifold (11). When in general use the stored heat is removed by means of a hot water manifold (23), and may be used for domestic purposes, (22) cold water replenishment supply.

I claim:

1. A heat accumulating and heat transferring apparatus comprising:

a hollowed vessel spherically arranged, having an internally arranged along the innermost spherically surface a heat conducting inner liner, said hollowed vessel which is spherically arranged, having ports disposed opposite each other, one port to receive fuel injection/firing means and the other to receive a pressure regulator control valve, said hollowed vessel which is spherically arranged where said fuel injection may be combusted in a systematic manner based on the demand of the said pressure regulator valve, releasing in the combustion process heat energy, said hollowed vessel which is spherically arranged where said pressure control valve is permitted to allow the evacuation of excess pressure, in terms of build up heat into a secondary heat exchanger, said hollowed vessel which is spherically arranged where said heat energy is allowed to be absorbed through the said inner liner, into a heat storage chamber, said hollowed vessel which is spherically arranged where said heat storage chamber contains materials such as silica gel, which when heated becomes liquified, allowing in the process more and more heat to be collected becoming a reservoir of stored heat energy, said hollowed vessel which is spherically arranged where said reservoir of stored heat energy is protected from heat loss by an outer jacket housing and insulating materials, said hollowed vessel which is spherically arranged having a primary heat exchanger comprised of built in air passage ways said hollowed vessel which is spherically arranged where said outer jacket housing and insulation materials are further surrounded by an outermost housing arrangement to provide mounting for the apparatus.

2. A heat accumulating and heat transferring apparatus as in claim 1 having metered fuel injection controls for systematic combustion.

3. A heat accumulating and heat transferring apparatus as in claim 1 having a control regulator valve for controlling the internal pressure of the build up heat energy.

4. A heat accumulating and heat transferring apparatus as in claim 1 having a spherically arranged combustion chamber, where a fuel mixture is systematically ignited and combusted to release heat energy.

5. A heat accumulating and heat transferring apparatus as in claim 1 having a heat reservoir consisting of a gel like material, which liquifies as the heat is built up and contracts into a natural gel state as the stored heat is extracted or lost.

6. A heat accumulating and heat transferring apparatus as in claim 1, having companion outer housing arranged to provide containment of the gel like materials and to provide adequate insulation means and to provide for the entire apparatus a rigid mounting means.

7. A heat accumulation and heat transferring apparatus as in claim 3, where said control regulator valve is automatically adjusted to permit excessive heat pressure to be evacuated into a secondary heat exchanger.

8. A heat accumulation and heat transferring apparatus as in claim 1 or 7 where said secondary heat exchanger is integrated with the said primary heat exchanger.

* * * * *